US009709321B2

(12) United States Patent
Yang

(10) Patent No.: US 9,709,321 B2
(45) **Date of Patent: *Jul. 18, 2017**

(54) REFRIGERATOR AND METHOD OF REPLACING WATER TANK FOR REFRIGERATOR

(71) Applicant: Dongbu Daewoo Electronics Corporation, Seoul (KR)

(72) Inventor: Sung Jin Yang, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 71 days.

This patent is subject to a terminal disclaimer.

(21) Appl. No.: 14/588,860

(22) Filed: Jan. 2, 2015

(65) Prior Publication Data

US 2016/0131417 A1 May 12, 2016

(30) Foreign Application Priority Data

Nov. 6, 2014 (KR) ..... 10-2014-0153709

(51) Int. Cl.

| | |
|---|---|
| ***B67D 7/06*** | (2010.01) |
| ***F25D 23/12*** | (2006.01) |
| ***B67D 1/00*** | (2006.01) |
| ***B67D 1/07*** | (2006.01) |
| ***F25D 23/04*** | (2006.01) |

(52) U.S. Cl.

CPC ..... *F25D 23/126* (2013.01); *B67D 1/0009* (2013.01); *B67D 1/07* (2013.01); *F25D 23/04* (2013.01); *B67D 2001/075* (2013.01); *F25D 2323/122* (2013.01)

(58) Field of Classification Search

CPC ..... F25D 23/126; F25D 23/00; F25D 23/02; F25D 23/04; F25D 2323/122; F25D 25/00; F25D 11/00; F25D 19/00; B67D 1/0009; B67D 1/07; B67D 2001/075

USPC ..... 222/183

See application file for complete search history.

(56) References Cited

U.S. PATENT DOCUMENTS

| | | | | |
|---|---|---|---|---|
| 2,274,409 A * | 2/1942 | Harbison | ..... | F25D 23/126 222/183 |
| 2,512,395 A * | 6/1950 | Sundberg | ..... | F25D 23/126 222/182 |
| 2,718,127 A * | 9/1955 | Minor | ..... | F25D 23/126 222/146.6 |

(Continued)

FOREIGN PATENT DOCUMENTS

| | | |
|---|---|---|
| JP | S49104057 U | 9/1974 |
| JP | H09155369 A | 6/1997 |

(Continued)

OTHER PUBLICATIONS

KR2011072369—English Translation, machine generated, Sep. 2016.*

*Primary Examiner* — J. Casimer Jacyna
*Assistant Examiner* — Benjamin R Shaw

(57) ABSTRACT

A refrigerator equipped with a water tank that is easily accessible to a user and a method of using the same. A water dispenser is installed on the front side of a refrigerator. A water tank coupled to the water dispenser is detachably installed on a lower inner inside of a refrigerator door such that a user can conveniently observe the state of the water tank and access the water tank for maintenance and refill.

6 Claims, 10 Drawing Sheets

(56) References Cited

U.S. PATENT DOCUMENTS

| | | | | |
|---|---|---|---|---|
| 3,208,641 | A * | 9/1965 | Brugioni | F25D 23/126 222/108 |
| 3,299,663 | A * | 1/1967 | Butcher | F25D 23/126 62/339 |
| 2006/0144066 | A1* | 7/2006 | Lee | F25D 23/12 62/238.6 |
| 2010/0229592 | A1* | 9/2010 | Lim | B01D 35/02 62/389 |
| 2012/0060540 | A1* | 3/2012 | Yang | F25C 5/005 62/340 |
| 2012/0285192 | A1* | 11/2012 | Mitchell | C02F 1/003 62/318 |
| 2012/0297814 | A1* | 11/2012 | Kim | F25C 5/005 62/340 |
| 2013/0105513 | A1 | 5/2013 | Krause et al. | |
| 2013/0108249 | A1* | 5/2013 | Krause | B67D 3/0022 392/465 |
| 2013/0133355 | A1* | 5/2013 | Park | F25D 23/12 62/340 |
| 2016/0131418 | A1* | 5/2016 | Yang | F25D 23/126 222/1 |

FOREIGN PATENT DOCUMENTS

| | | |
|---|---|---|
| KR | 200141879 | 6/1999 |
| KR | 20050051980 | 6/2005 |
| KR | 1020060027466 | 3/2006 |
| KR | 10-2008-0024924 A | 3/2008 |
| KR | 20110072369 A | 6/2011 |

* cited by examiner

REFRIGERATOR AND METHOD OF REPLACING WATER TANK FOR REFRIGERATOR

CROSS-REFERENCE TO RELATED APPLICATION

This application claims priority and benefit from Korean Patent Application No. 10-2014-0153709, filed on Nov. 6, 2014, with the Korean Intellectual Property Office, the disclosure of which is incorporated herein in its entirety by reference.

TECHNICAL FIELD

Embodiments of the present disclosure relate to refrigerators, and more specifically, to mechanisms of supplying drinking water from refrigerators.

BACKGROUND

In general, a refrigerator is an apparatus for preserving food and other items in a cool or a frozen state by circulating cold air that is generated via a cooling system.

Typically, a refrigerator has a freezing chamber and a refrigerating chamber disposed at the upper and lower sides of the refrigerator, respectively. Recently, refrigerators with two storage chambers disposed side-by-side are also available on the market. Such a side-by-side refrigerator is often equipped with a water dispenser coupled to a water purifier and used to supply drinking water (water or any beverage which is consumable or may be used to cook food) or ice.

As illustrated in FIG. 1, a refrigerator 100 in the related art includes a main frame 110 having a machine chamber (not illustrated), a freezing chamber 120, and a refrigerating chamber 130. A freezing chamber door 122 and a refrigerating chamber door 132 are hingedly coupled to the main frame 110.

A water supply valve (not illustrated) is provided in the machine chamber formed behind the main frame 110.

A dispenser 124 for dispensing drinking water is disposed at the front side of the freezing chamber door 122. A water tank 140 for storing drinking water supplied to the dispenser 124 is provided behind a refrigerator drawer 130. The water supply pipe 153 is coupled to the water tank 140 via the water supply valve. The other end of the water tank 140 is coupled to a water drain pipe 155 and is used to supply drinking water to the dispenser 124.

However, according to a refrigerator in the related art, the water tank is usually designed to be enclosed in a case disposed in the machine chamber. In this location, it is difficult for a user to locate and access the water tank for maintenance or replacement. Further, the structure of the water tank makes it difficult for a user to replace the water tank. Accordingly, a user cannot easily remove unwanted foreign substances accumulated on the water tank, such as substances produced by the dispenser or the ice maker.

LITERATURE OF RELATED ART

Patent Literature

Korean Patent No. 0630910 (LG Electronics Co., Ltd.) (Sep. 26, 2006). Patent Literature 1 relates to a structure for installing a water tank of a refrigerator, and discloses that the water tank is installed in a freezing chamber door in order to supply cool water at a low temperature.

SUMMARY

Embodiments of the present disclosure are directed to providing a refrigerator having a water tank that can be easily detached from the refrigerator for maintenance or replacement thereof.

According to an embodiment, a refrigerator includes: one or more refrigerating chambers and corresponding refrigerator doors; a dispenser unit which is provided in the refrigerator door and supplies drinking water; and a water tank which supplies water to the dispenser unit. The water tank is detachably mounted at a lower end inside the refrigerator door.

The refrigerator may further include: a water outflow line through which water is supplied to the dispenser unit; a first coupling member which has one end coupled to a water outflow groove formed in the water tank, and the other end coupled to the water outflow line; a water supply line through which water is supplied from a water supply source; and a second coupling member which has one end that has a water supply nozzle made of a flexible material and is coupled to a water supply groove formed in the water tank, and the other end coupled to the water supply line.

The refrigerator may further include a water tank fixing member which is coupled to the lower inner side the refrigerator door on which the water tank is installed. The water tank is fitted into and coupled to the water tank fixing member.

The inner circumferential surface of the water tank fixing member may be conformal to the outer circumferential surface of the water tank.

The refrigerator may further include a water tank door coupled to the refrigerator door and operable to cover the water tank. The water tank door may be made of a transparent material such that the water tank is visible through the water cover.

The water tank may be made of a transparent material such that the interior of the water tank is visible to users. The water tank is installed at a lower end of an accommodating drawer 304 mounted on the inner side of the refrigerator door.

The refrigerator may further include a water drain bolt is coupled to a water drain groove that is formed at one end of the water tank.

The refrigerator may further include a sterilizing unit installed at a lower inner side of the refrigerator door and proximate to the water tank. The sterilizing unit has an ultraviolet ray lamp for irradiating the tank.

Another exemplary embodiment of the present disclosure provides a method of replacing a water tank for a refrigerator, including: separating a water tank installed at a lower inner side of a refrigerator door from a water tank fixing member; detaching the water tank by pulling the water tank in a direction toward a water drain bolt coupled to the water tank; cleaning the water tank; inserting a water supply nozzle into the cleaned water tank; coupling the cleaned water tank to the first and second coupling members by inserting the cleaned water tank in a direction toward the first and second coupling members; and fitting and coupling the cleaned water tank into the water tank fixing member.

According to the refrigerator and the method of replacing the water tank for a refrigerator according to the present disclosure, the water tank may be detachably coupled to the inner side of the refrigerator door, thereby allowing the user to easily access the water tank for maintenance and replacement thereof.

Since the water tank is installed on the lower inner side of the refrigerator door, which is a region that is not freqeuently used by the user, the water tank advantageoulsy does not interfere with users' regular use of the refrigerator.

The water tank door, for covering the water tank, may be transparent, so a user may easily identify the condition and state of the water tank when viewing through the tank door. Accordingly, the user can determine whether foreign substances are present in the water tank and call for maintenance. The water tank may be made of a transparent material, thereby allowing the user to easily visualize the contamination level of water stored in the water tank.

A sterilizing unit is installed on the inner surface of the refrigerator door and proximate to the water tank. The sterilize unit includes a can sterilizes water by irradiating the water tank with ultraviolet rays.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

A refrigerator according to an exemplary embodiment of the present disclosure is described with reference to FIGS. 2 and 3.

Figure 1:
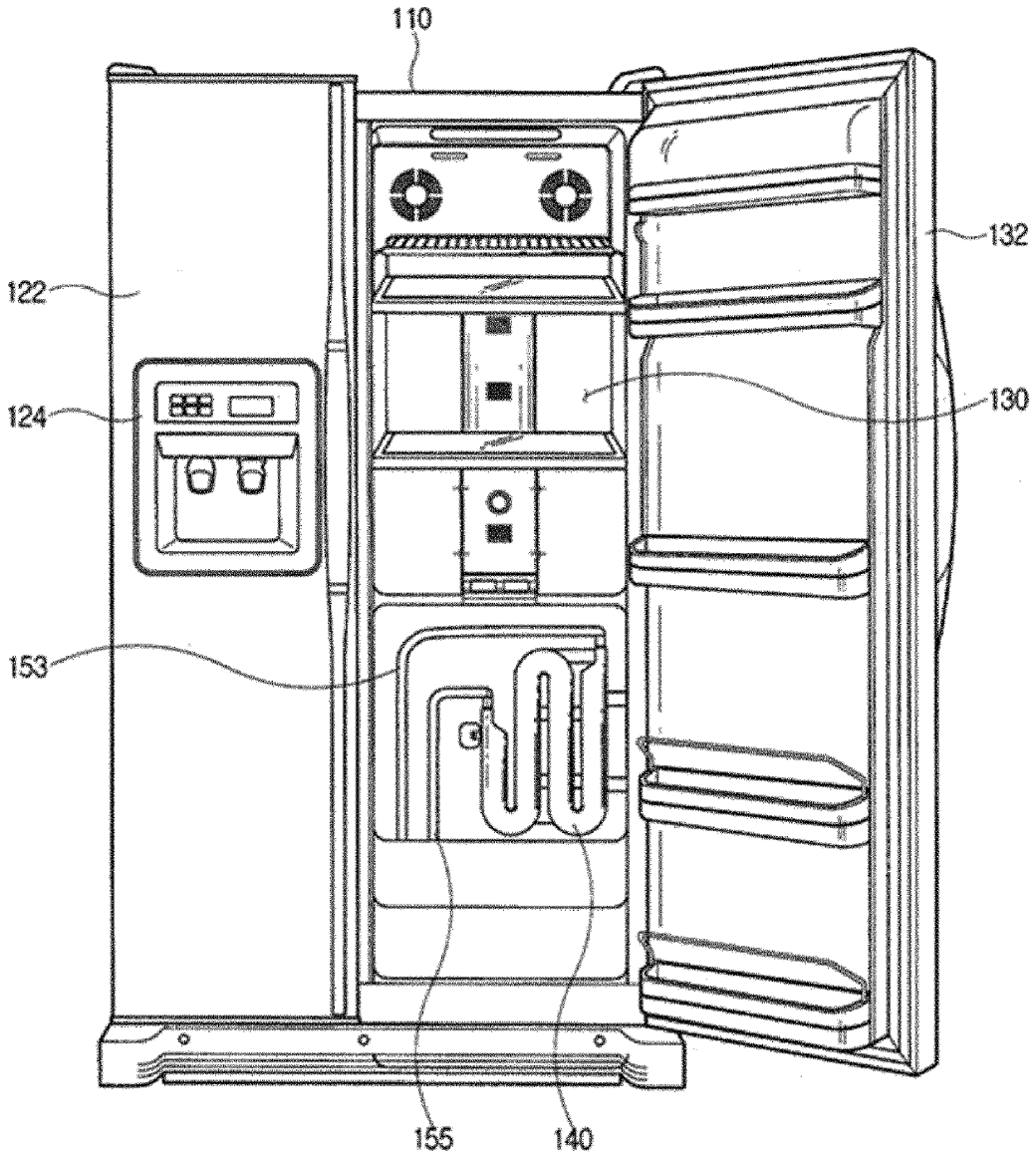
FIG. 1 PRIOR ART
FIG. 1 is a perspective view of a refrigerator in the related art.
Figure 2:
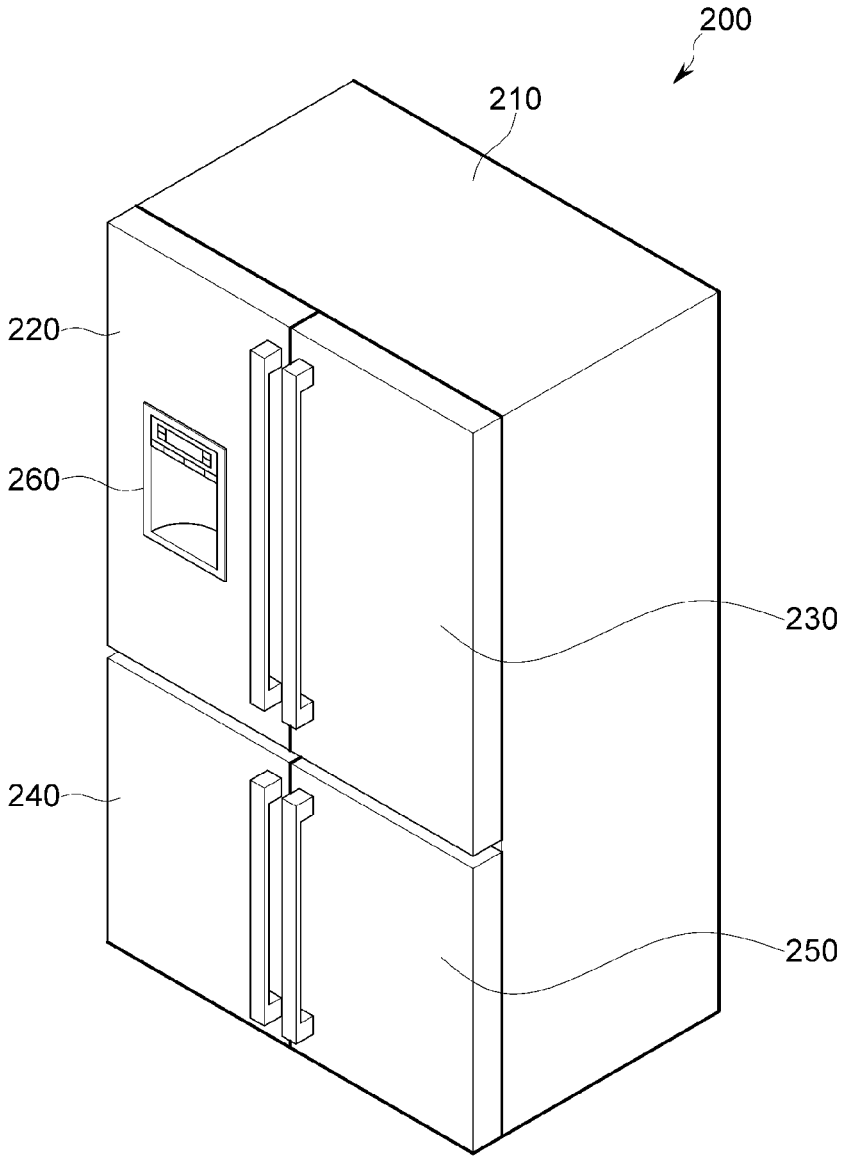
FIG. 2 illustrates a perspective view of an exemplary refrigerator according to an embodiment of the present disclosure.

FIG. 2 illustrates a perspective view of an exemplary refrigerator according to an embodiment of the present disclosure. The refrigerator 200 includes a main frame 210 which has a machine chamber (not explicitly illustrated), a refrigerating chamber (not explicitly illustrated), a freezing chamber (not explicitly illustrated), and a plurality of refrigerator doors 220, 230, 240, and 250 coupled to the main frame 210.

Figure 8:
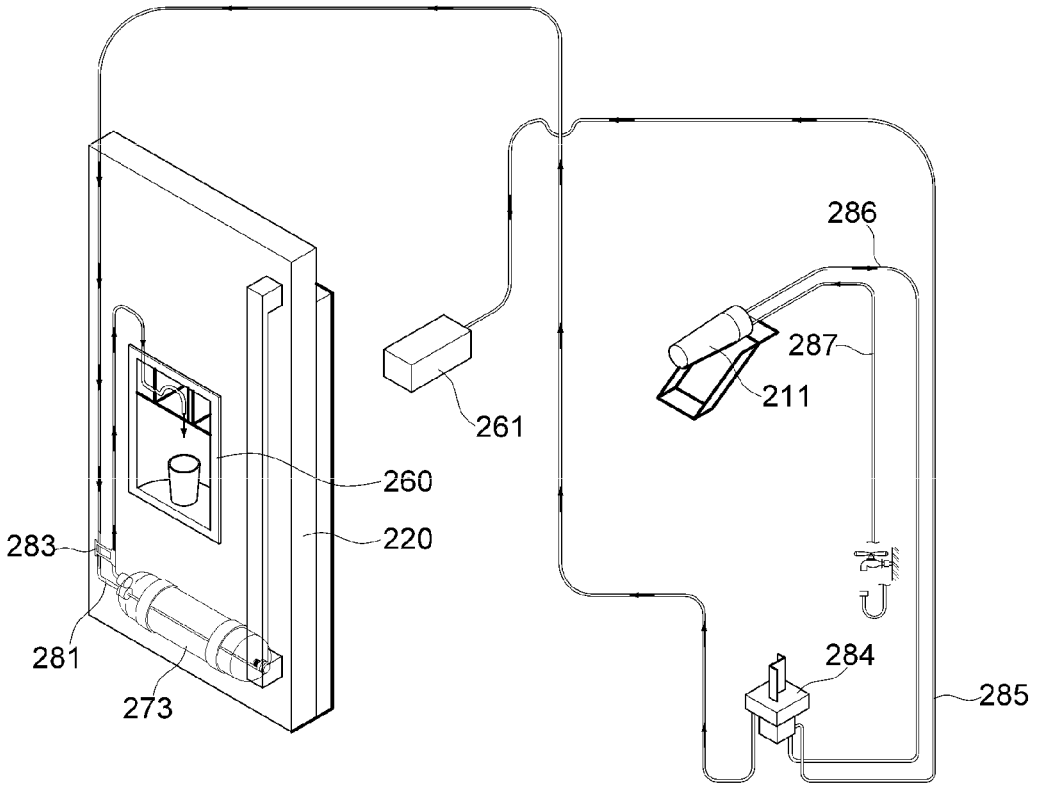
FIG. 8 illustrates an exemplary water flow path according to an embodiment of the present disclosure.

A dispenser unit 260 for supplying drinking water (and/or other beverages) is provided on the front side of the first refrigerator door 220. An ice maker 261 as shown in FIG. 8 for making and supplying ice may also be coupled to the dispenser unit 260.

FIG. 2 illustrates an example in which the refrigerator 200 according to the present disclosure has four refrigerator doors, but the present disclosure is not limited thereto. For example, two refrigerator doors may be provided on the upper and lower sides or on the left and right sides of the refrigerator, respectively. A dispenser unit according to the present disclosure may be disposed in anyone of the refrigerator doors.

Figure 3:
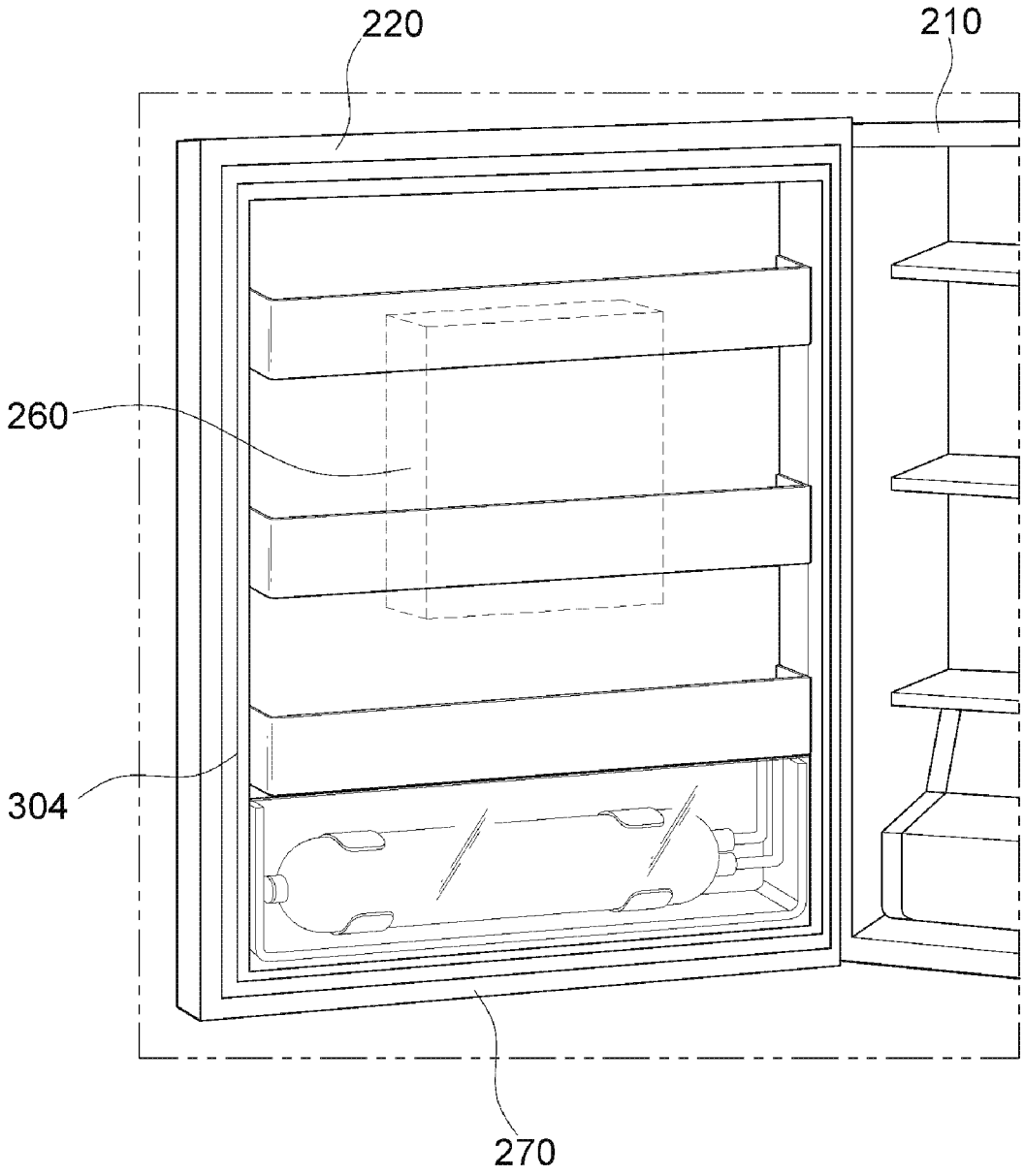
FIG. 3 illustrates an exemplary refrigerator door installed with a water tank according to an embodiment of the present disclosure.

FIG. 3 illustrates an exemplary refrigerator door installed with a water tank according to an embodiment of the present disclosure. The water tank unit 270 is installed on a lower inner side of the first refrigerator door 220, while the dispenser unit 260 is installed on the outer side of door 220. The water tank unit 270 stores water supplied from a water supply source (not illustrated), and supplies water to the dispenser unit 260. Here, water supplied from the water supply source may be supplied to the water tank unit 270 after being purified by a filter unit 211. Since the water tank is disposed on the inner side of the refrigerator door, it is easily visible to a user.

The water tank unit 270 may be installed on or in a storage compartment installed on the first refrigerator door 220. As described above, the water tank is installed below the lowest drawer of the refrigerator door 220. This is a region that is not frequently used by a user, thereby allowing the user to easily locate the water tank without causing any inconvenience in the refrigerator use.

An exemplary water tank unit according to the present disclosure is described in more detail with reference to FIGS. 4 to 7.

Figure 4:
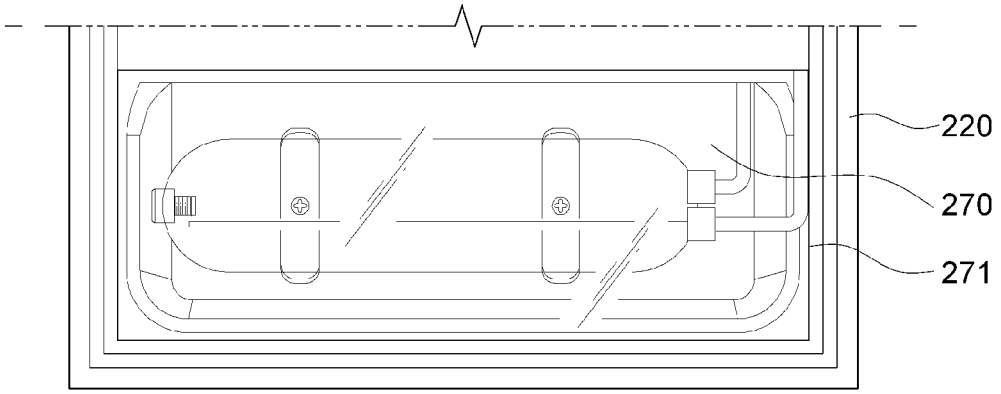
FIG. 4 illustrates the configuration of an exemplary water tank viewed through a closed water tank door according to an embodiment of the present disclosure.
Figure 5:
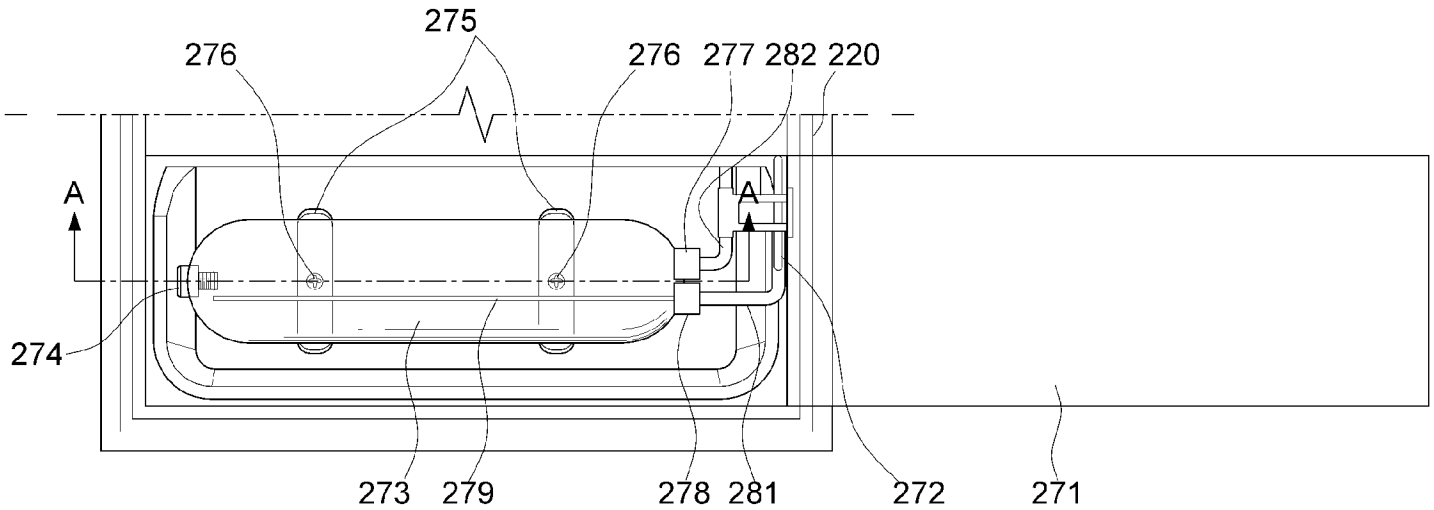
FIG. 5 illustrates the configuration of the exemplary water tank while the water tank door is open according to an embodiment of the present disclosure.
Figure 6:
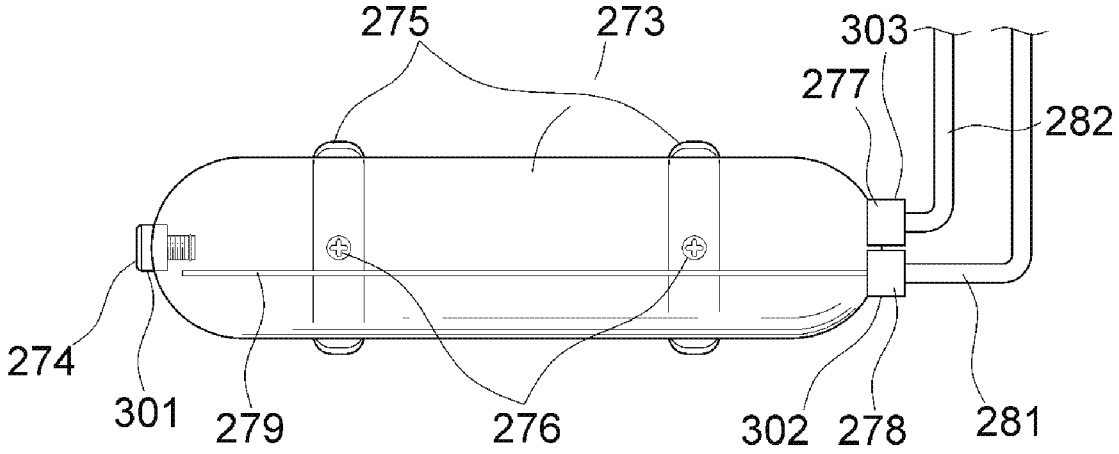
FIG. 6 is a cross-sectional view taken along line A-A of FIG. 5.

FIG. 4 illustrates the configuration of an exemplary water tank viewed through a closed water tank door according to an embodiment of the present disclosure. FIG. 5 illustrates the configuration of the exemplary water tank viewed while the water tank door is open. FIG. 6 is a cross-sectional view taken along line A-A of FIG. 5.

Referring to FIGS. 4 to 6, the water tank unit 270 installed on the inner side of the first refrigerator door 220 may include a water tank door 271, a door coupling member 271, a water tank 273, a water drain bolt 274, water tank fixing members 275, screws 276, a first coupling member 277, and a second coupling member 278.

The water tank door 271 is installed on the inner side of the first refrigerator door 220, and operable to cover the water tank 273 that supplies water to the dispenser unit 260. The water tank door 271 is coupled to the inner side of the first refrigerator door 220 by the door coupling member 272.

The water tank door 271 can be made of a transparent material such that the water tank 273 is visible to users through the tank door 271. By viewing through the tank door 271, a user may easily identify the state and condition of the water tank and accordingly decide whether maintenance is needed for the tank. For example, maintenance may be needed to remove foreign substances that are produced by the dispenser and accumulate in the water tank over time. The water tank 273 may also be made of a transparent material such that the interior of the water tank 273 is visible to users. This helps a user to determine the condition of the water in the water tank 273, e.g., the contamination level thereof.

The water tank 273 may be fitted into and coupled to the water tank fixing members 275. The water tank fixing members 275 are fixedly coupled to the inner side of the first refrigerator door 220 and used to fix the water tank 273 onto the first refrigerator door 220. Here, the water tank fixing members 275 are fixed to the inner surface of the first refrigerator door 220 by the screws 276.

The inner circumferential surface of the water tank fixing member 275 may be conformal to an outer circumferential surface of the water tank 273. For example, as illustrated in FIG. 5, the outer circumferential surface of the water tank 273 has a cylinder shape. Thus, the inner circumferential surface of the water tank fixing member 275 defines a "C"-shaped space so that the water tank 273 can be fitted into and coupled to the water tank fixing member 275. However, it will be appreciated that the water tank and the water tank fixing members may be formed in various other shapes in other embodiments.

The water tank unit 270 has first coupling member 277 and second coupling member 278, and may be coupled to a water supply line through which water is supplied to the water tank 273 and a water outflow line through which water is supplied to the dispenser unit 260. That is, the water tank 273 has a water supply groove 302 and a water outflow groove 303 formed at the ends. One end of the first coupling member 277 may be coupled to the water outflow groove 303 of the water tank 273, and the other end of the first coupling member 277 may be coupled to the water outflow line 282 through which water is supplied to the dispenser unit 260. One end of the second coupling member 278 may be coupled to the water supply groove 302 of the water tank 273, and the other end of the second coupling member 278 may be coupled to the first water supply line 281 through which water is supplied from the water supply source. The second coupling member 278 is coupled to a flexible water supply nozzle 279 made of any suitable flexible material.

A water drain groove 301 is formed at the other end of the water tank 273, and the water drain bolt 274 may be coupled to the water drain groove 301. The user may easily drain water remaining in the water tank 273 to the outside by removing the water drain bolt 274 that is coupled to the water drain groove 301 of the water tank 273 as described above.

Figure 7:
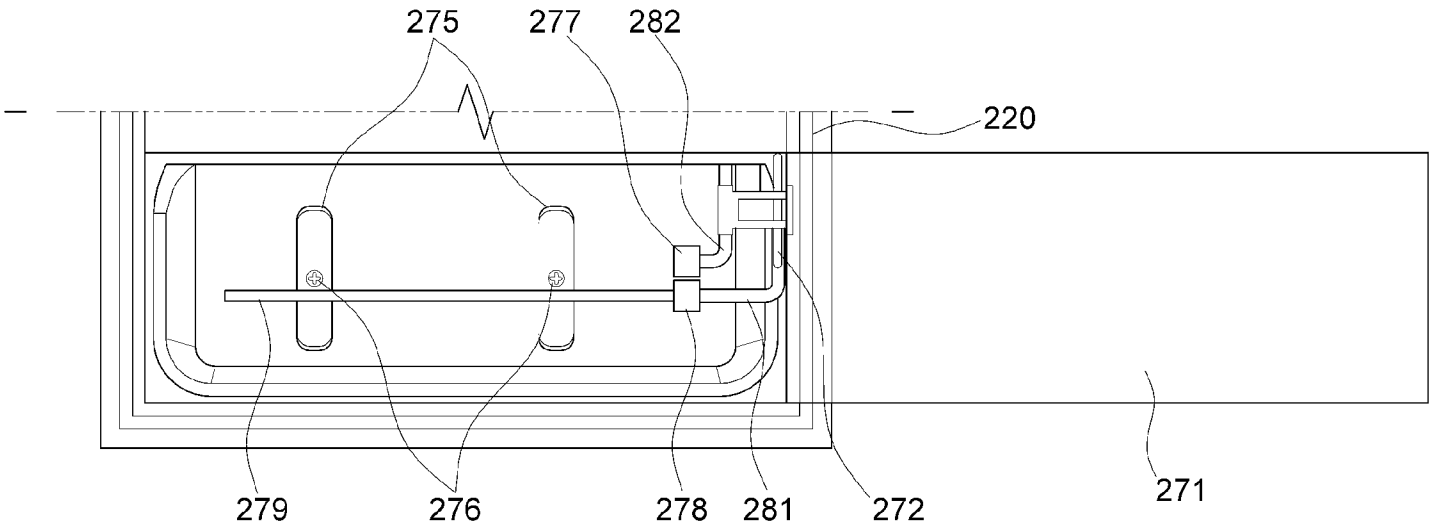
FIG. 7 illustrates the configuration of an exemplary refrigerator door with the water tank removed according to an embodiment of the present disclosure.

FIG. 7 illustrates the configuration of an exemplary refrigerator door with the water tank removed according to an embodiment of the present disclosure. FIG. 7 shows the coupling mechanisms associated with the water tank.

The water tank 273 is detachably installed on the inner side of the first refrigerator door 220, and the water tank 273 may be detached as illustrated in FIG. 7. That is, the user may detach the water tank 273 by separating the water tank 273 from the water tank fixing member 275, and then pulling the water tank 273 from the first and second coupling members 277 and 278 toward the water drain bolt 274 coupled to the water tank 273.

In this case, since the water supply nozzle 279 is made of a flexible material, the user may easily detach the water tank. By the same token, a user can install the water tank 273 back to the refrigerator door 220 by reversely performing the operation of detaching the water tank 273 as described above.

FIG. 8 illustrates an exemplary water flow path according to an embodiment of the present disclosure.

Referring to FIG. 8, the water supply source supplies water to the filter unit 211 through a fourth water supply line 287. Then, the filter unit 211 purifies water supplied from the water supply source through the fourth water supply line 287. The purified water is supplied to a second valve 284 through a third water supply line 286. The second valve 284 supplies water to the ice maker 261 through a second water supply line 285 and supplies water to the water tank 273 through the first water supply line 281. The ice maker 261 makes ice using water and provides the user with the ice. The water tank 273 stores water supplied from the second valve 284 through the first water supply line 281 and supplies the stored water to the dispenser unit 260 through the water outflow line 282. A first valve 283 may be provided on the first water supply line 281 through which water is supplied to the water tank 273. The first valve 283 is operable to shut off the water supply. More specifically, the first valve 283 can be a ball valve and can be used by a user to shut off water supply to the water tank 273. Then, the dispenser unit 260 provides the user with drinking water supplied from the water tank 273 through the water outflow line 282.

Figure 9:
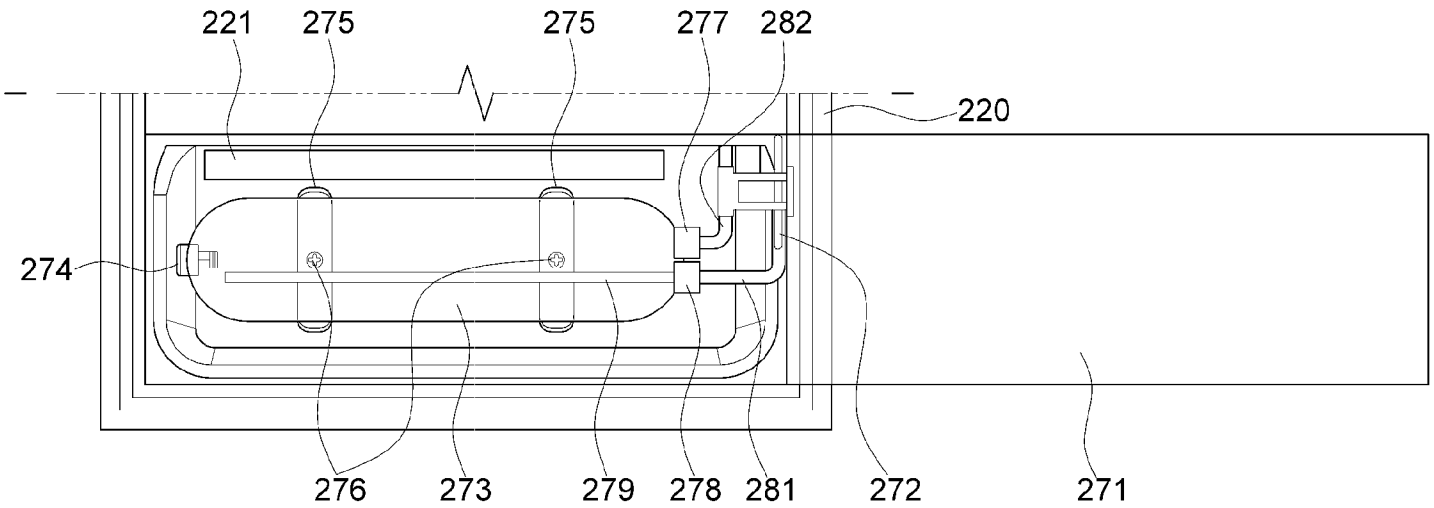
FIG. 9 illustrates an exemplary water tank unit according to another embodiment of the present disclosure.

FIG. 9 illustrates an exemplary water tank unit according to another embodiment of the present disclosure.

The water tank unit as shown in FIG. 9 is substantially the same as the water tank unit as shown in FIG. 5 except for the addition of a sterilizing unit.

The refrigerator 220 in FIG. 9 includes a sterilizing unit 221 installed on the inner side of the first refrigerator door 220 which has the water tank 273 installed.

The sterilizing unit 221 has an ultraviolet ray lamp and can irradiate the water tank 273 with ultraviolet rays. The ultraviolet rays can sterilize water stored in the water tank.

Figure 10:
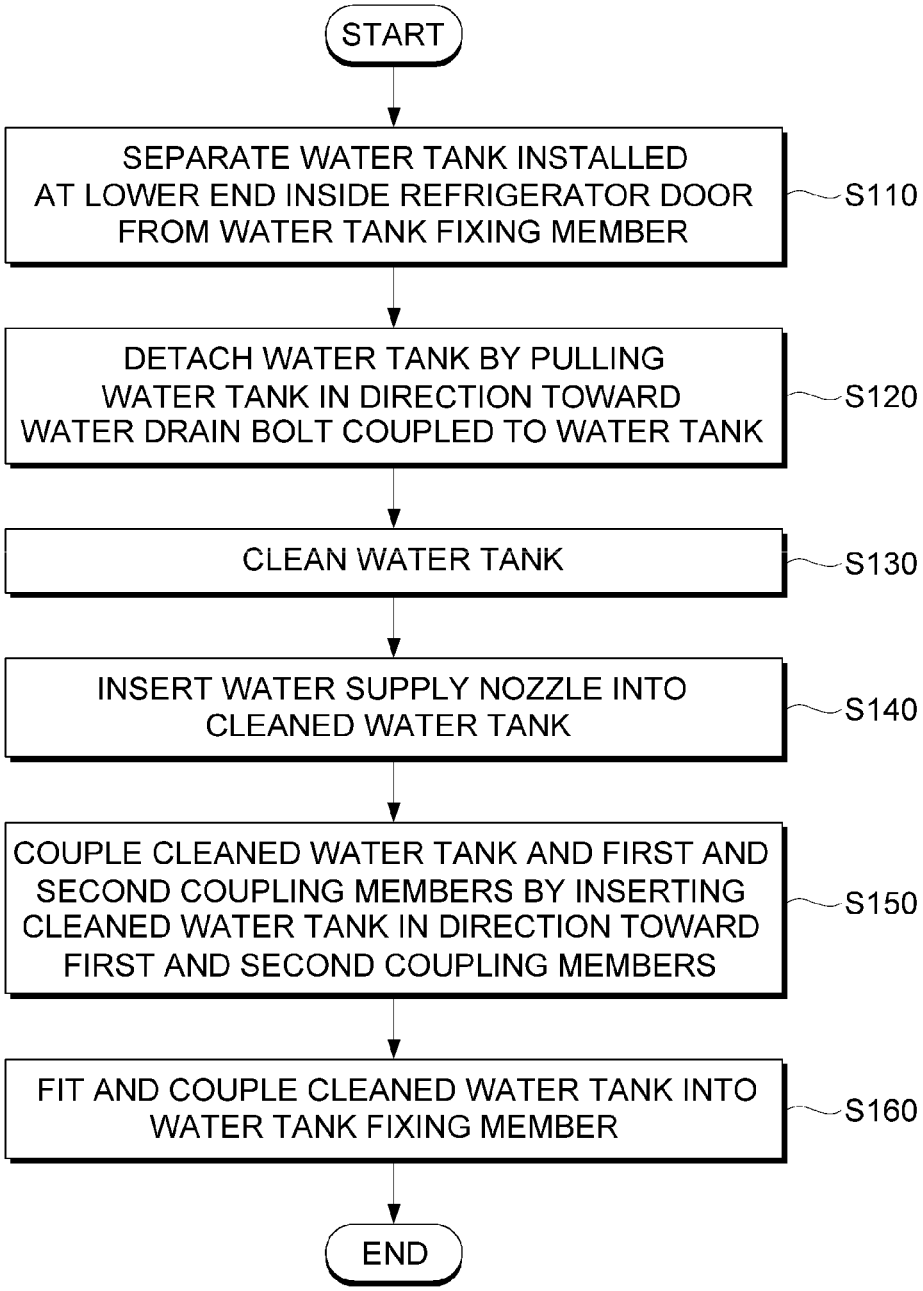
FIG. 10 is a flowchart depicting an exemplary method of water tank replacement for a refrigerator according to the embodiment of the present disclosure.

FIG. 10 is a flowchart depicting an exemplary method of replacing a water tank for a refrigerator according to an embodiment of the present disclosure.

Referring to FIG. 10, the water tank 273 installed at the lower inner side of the refrigerator door 220 is separated from the water tank fixing member 275 (S110) by a user. The water tank 273 is detached after a user pulls the water tank 273 in a direction toward the water drain bolt 274 coupled to the water tank 273 (S120). The user can then detached water tank 273 and clean it or replace it (S130).

The water supply nozzle 279 is then inserted into the cleaned water tank 273 (S140). A user can push the cleaned water tank 273 onto the first and second coupling members 277 and 278 (S150). Thereby, the cleaned water tank 273 is coupled to the water tank fixing member 275 (S160).

Reference is made in detail to the preferred embodiments of the present disclosure, examples of which are illustrated in the accompanying drawings. While the disclosure will be described in conjunction with the preferred embodiments, it will be understood that they are not intended to limit the disclosure to these embodiments.

On the contrary, the disclosure is intended to cover alternatives, modifications and equivalents, which may be included within the spirit and scope of the disclosure as defined by the appended claims. Furthermore, in the following detailed description of embodiments of the present disclosure, numerous specific details are set forth in order to provide a thorough understanding of the present disclosure. However, it will be recognized by one of ordinary skill in the art that the present disclosure may be practiced without these specific details. In other instances, well-known methods, procedures, components, and circuits have not been described in detail so as not to unnecessarily obscure aspects of the embodiments of the present disclosure. The drawings showing embodiments of the disclosure are semi-diagrammatic and not to scale and, particularly, some of the dimensions are for the clarity of presentation and are shown exaggerated in the drawing Figures. Similarly, although the views in the drawings for the ease of description generally show similar orientations, this depiction in the Figures is arbitrary for the most part. Generally, the disclosure can be operated in any orientation.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present disclosure, discussions utilizing terms such as "processing" or "accessing" or "executing" or "storing" or "rendering" or the like, refer to the action and processes of a computer system, or similar electronic computing device, that manipulates and transforms data represented as physical (electronic) quantities within the computer system's registers and memories and other computer readable media into other data similarly represented as physical quantities within the computer system memories or registers or other such information storage, transmission or client devices. When a component appears in several embodiments, the use of the same reference numeral signifies that the component is the same component as illustrated in the original embodiment.

Although certain preferred embodiments and methods have been disclosed herein, it will be apparent from the foregoing disclosure to those skilled in the art that variations and modifications of such embodiments and methods may be made without departing from the spirit and scope of the disclosure. It is intended that the disclosure shall be limited only to the extent required by the appended claims and the rules and principles of applicable law.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A refrigerator comprising:

a refrigerating chamber configured to store items placed therein;

a refrigerator door for the refrigerating chamber;

a dispenser unit coupled to the refrigerator door and configured to dispense drinking water; and a water tank configured to store and supply water to the dispenser unit, wherein the water tank is detachably coupled to an inner side of the refrigerator door;

a water outflow line coupled to the dispenser unit and configured to supply water to the dispenser unit;

a first coupling member comprising: a first end coupled to a water outflow groove formed on the water tank, wherein the water tank is inserted in a direction toward the first coupling member to allow water to flow through the water outflow groove; and a second end coupled to the water outflow line;

a water supply line coupled to a water supply source and configured to supply water from the water supply source; and a second coupling member comprising: a first end having a water supply nozzle made of a flexible material; and a second end coupled to the water supply line, wherein the water supply nozzle is coupled to a water supply groove formed in the water tank, wherein the water supply nozzle is inserted into the water tank to allow water to flow through the water supply groove and the water supply groove, wherein the water tank is made of a transparent material and is installed at a lower end of an accommodating drawer mounted on the inner side of the refrigerator door.

2. The refrigerator of claim 1 further comprising:

a water tank fixing member coupled at a lower inner of the refrigerator door, wherein the water tank is coupled to the refrigerator door via the water tank fixing member.

3. The refrigerator of claim 2, wherein an inner circumferential surface of the water tank fixing member is conformal to an outer circumferential surface of the water tank.

4. The refrigerator of claim 1 further comprising:

a water tank door operable to cover the water tank, wherein the water tank door is made of a transparent material wherein the water tank is visible through the water tank door.

5. The refrigerator of claim 1, further comprising:

a water drain bolt coupled to a water drain groove formed at one end of the water tank, wherein water flows through the water drain groove when the drain bolt is removed.

6. The refrigerator of claim 1 further comprising:

a sterilizing unit disposed proximate to the water tank and comprising an ultraviolet ray lamp.

* * * * *